US006540340B2

(12) United States Patent
Thorpe et al.

(10) Patent No.: US 6,540,340 B2
(45) Date of Patent: Apr. 1, 2003

(54) INK SUPPLY SYSTEM

(76) Inventors: Timothy R. Thorpe, 113 Perne Road, Cambridge CB1 3SB (GB); Paul R. Drury, 91 Garden Walk, Royston, Hertfordshire SG8 7JN (GB)

( * ) Notice: Subject to any disclaimer, the term of this patent is extended or adjusted under 35 U.S.C. 154(b) by 0 days.

(21) Appl. No.: 09/833,246

(22) Filed: Apr. 11, 2001

(65) Prior Publication Data

US 2002/0015083 A1 Feb. 7, 2002

Related U.S. Application Data

(63) Continuation of application No. PCT/GB99/03483, filed on Oct. 21, 1999.

(30) Foreign Application Priority Data

Oct. 21, 1998 (GB) ..... 9822875

(51) Int. Cl.[7] ..... B41J 2/175
(52) U.S. Cl. ..... 347/85
(58) Field of Search ..... 347/7, 84, 85, 347/86, 87; 346/75

(56) References Cited

U.S. PATENT DOCUMENTS

| | | | | |
|---|---|---|---|---|
| 4,539,570 A | * | 9/1985 | Moore | 346/75 |
| 4,737,801 A | | 4/1988 | Ichihashi et al. | 347/85 |
| 5,008,688 A | | 4/1991 | Ebinuma et al. | 347/86 |
| 5,055,857 A | | 10/1991 | Regnault | 347/89 |
| 5,757,390 A | * | 5/1998 | Gragg et al. | 347/7 |

FOREIGN PATENT DOCUMENTS

WO WO 98/19864 5/1998

OTHER PUBLICATIONS

International Search Report in PCT/GB99/03483 dated Jan. 13, 2000.

International Preliminary Examination Report in PCT/GB99/03483 dated Jan. 23, 2001.

* cited by examiner

*Primary Examiner*—Anh T. N. Vo
(74) *Attorney, Agent, or Firm*—Marshall, Gerstein & Borun

(57) ABSTRACT

An ink supply system for supplying ink to a printhead comprises at least one ink manifold comprising a plurality of outlets for supplying ink from the manifold to the printhead, and at least one valve for selectively closing at least one of the outlets in order to increase the pressure of the ink supply from an open outlet to the printhead.

33 Claims, 6 Drawing Sheets

FIG. 2
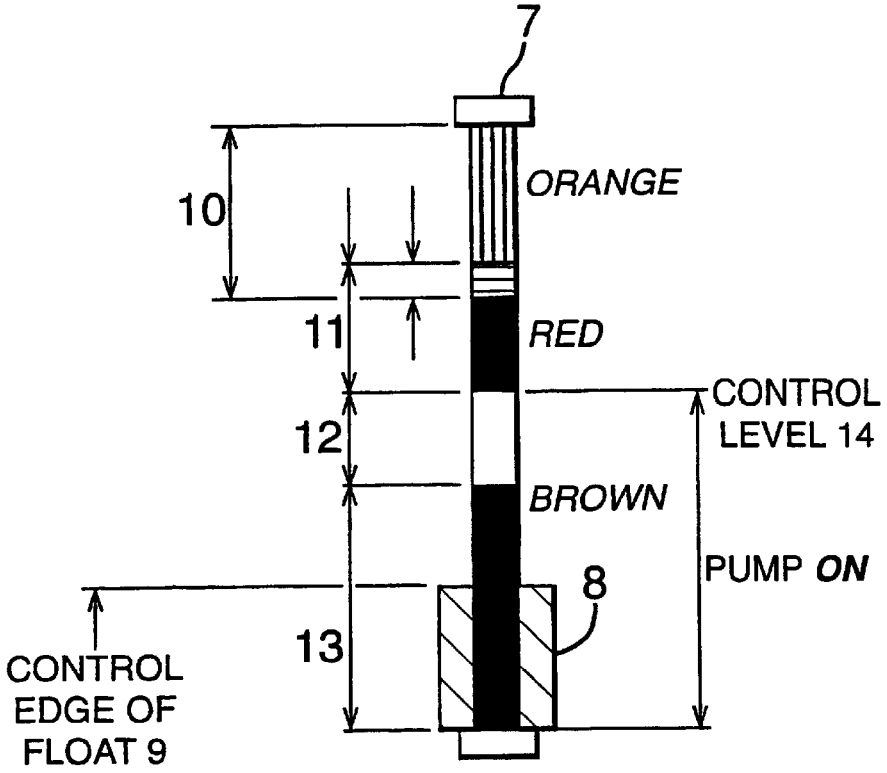
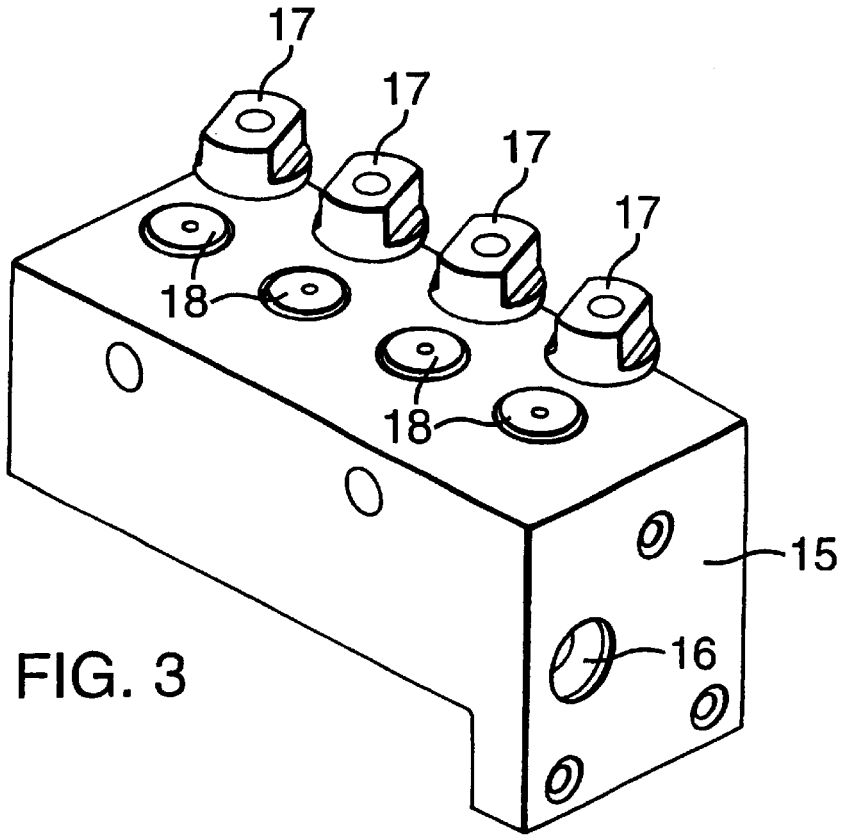
FIG. 3

INK SUPPLY SYSTEM

This is a continuation of International Application No. PCT/GB99/03483 filed Oct. 21, 1999, the entire disclosure of which is incorporated herein by reference.

The present invention relates to an ink supply system, such as an ink supply system for an inkjet printhead.

In order to increase the speed of inkjet printing, inkjet printheads are typically provided with an increasing number of ink ejection channels. For example, there are commercially available inkjet printheads having in excess of 500 ink ejection channels, and it is anticipated that in future so called "pagewide printers" could include printheads containing in excess of 2000 ink ejection channels.

During inkjet printing, the quality of printing has been found to deteriorate due to a number of problems associated with the supply of ink from an ink reservoir to the printed page, for example, due to blockage of the nozzles of the printhead and drying of ink on the nozzle plate.

Various solutions to these problems have been proposed, including capping, wiping of the nozzle plate and "purging" of the ink in the printhead by forcing ink from all of the nozzles to clear blockages in the ink supply to the nozzles. However, such a purging mechanism can result in the wastage of a large volume of ink, particularly in pagewide printers, if not all of the nozzles have ejection problems.

In at least its preferred embodiment, the present invention seeks to solve these and other problems.

In a first aspect, the present invention provides an ink supply system for supplying ink to a printhead, said system comprising:

at least one ink manifold comprising a plurality of outlets for supplying ink from the manifold to said printhead; and means for selectively applying or increasing a pressure difference of an ink flow from at least one of the outlets to the printhead.

By selectively increasing the pressure of ink from at least one of the outlets to the printhead, localised higher-pressure purging of the printhead can be achieved than if the pressure of the ink flow from all of the outlets was the same. The ink supply may be pumped or gravity fed, and housekeeping routines can be conducted where ink is forcibly ejected through selected sections of the printhead. A higher ejection pressure in sections to be purged can therefore be achieved, and the amount of ink ejected during housekeeping can also be reduced.

In one preferred arrangement, the means for selectively increasing the pressure of ink from at least one of the outlets to the printhead comprises means for selectively substantially blocking the flow of ink from at least one of the outlets to the printhead to increase the pressure of the ink flow from an unblocked outlet to the printhead.

The ability to block off areas of the printhead from the ink supply can improve the priming and filling ability of the printhead. Printheads are generally supplied empty and need to be filled when installed, which can often lead to air being entrained within the printhead. Filling has previously been conducted by attaching a cap to the front face of the head and sucking the air from the printhead through the cap until ink flow from the nozzles is detected. Selectively blocking of one or more of the outlets can enable individual sections of the printhead to be primed in turn.

Thus, in a second aspect the present invention provides an ink supply system for supplying ink to a printhead, said system comprising:

at least one ink manifold comprising a plurality of outlets for supplying ink from the manifold to said printhead; and means for selectively substantially blocking the flow of ink from at least one of the outlets to the printhead in order to supply ink from an unblocked outlet to the printhead.

Preferably, the blocking means comprises at least one valve for selectively closing at least one of the outlets in order to supply ink from an open outlet to the printhead. Valves can be closed to channel ink into a particular section of the printhead or open to ensure that ink flows through the whole printhead. Selective opening and closing of the valves can facilitate vacuum filling of the printhead with ink. The printhead is typically vacuum filled by the application of a cap attached to a vacuum source to the front face of the printhead. A vacuum is applied to the head to exhaust air, and then the valves are quickly opened to allow ink to enter the printhead. Should air be trapped within a section of the head, particular attention can be given to this section by selectively closing a number of the valves. Preferably, the at least one valve is housed within the or each manifold.

The system may comprise a plurality of valves, each outlet being selectively closable by a respective valve. This can enable more selective opening and closing of the outlets of the manifold. The system may comprise a single manifold, or alternatively a plurality of manifolds for supplying ink to the printhead.

Means are preferably provided for supplying ink to the or each manifold. The ink supply means may comprise an ink reservoir for storing ink, and a pump for pumping ink from said reservoir to the or each manifold. The pump is preferably a diaphragm pump which, being essentially one-way, can ensure that any localised increase in the pressure of the ink flow to the printhead does not permeate back to the ink reservoir.

The ink supply means preferably comprises a tank for receiving ink supplied from said ink reservoir and supplying the received ink to the or each manifold. Ink flow through the tank is preferably arranged to reduce output pressure variations caused by fluctuations in the inlet pressure resulting from operations of the pump. The pressure purging routine is preferably instigated by the injection of ink into the tank. A valve may be provided for selectively connecting the tank to the reservoir to regulate the volume of ink in the tank. The tank may comprise means for indicating the volume of ink in that tank, for example, means for indicating the level of ink in the tank.

Instead of a single ink reservoir for storing, for example, black ink, the ink supply means may comprise a plurality of ink reservoirs for storing ink, the ink supply means being arranged to supply ink from each reservoir to at least one manifold. Preferably, each reservoir stores ink of a respective colour. For example, four reservoirs may be provided for storing black, cyan, yellow and magenta ink respectively.

With such a plurality of ink reservoirs, the ink supply means may comprise a plurality of pumps, each pump being arranged to pump ink from a respective reservoir to the at least one manifold, may comprise a plurality of tanks, each tank being arranged to receive ink supplied from a respective ink reservoir and supply the received ink to said at least one manifold, and may comprise a plurality of valves, each valve being arranged to selectively connect a respective tank to a respective reservoir to regulate the volume of ink in that tank.

The ink supply system suitably comprises means for filtering ink output from the or each manifold to the printhead.

The present invention extends to an ink supply system as aforementioned for supplying ink to a plurality of printheads.

In a third aspect, the present invention provides a method of supplying ink to a printhead, said method comprising the steps of:

providing at least one ink manifold comprising a plurality of outlets for supplying ink from the manifold to said printhead; and selectively applying or increasing a pressure difference of an ink flow from at least one of the outlets to the printhead.

In a fourth aspect, the present invention provides a method of supplying ink to a printhead, said method comprising the steps of:

providing at least one ink manifold comprising a plurality of outlets for supplying ink from the manifold to said printhead; and selectively substantially blocking the flow of ink from at least one of the outlets to the printhead in order to supply ink from an unblocked outlet to the printhead.

In a fifth aspect, the present invention provides a method of supplying ink to a printhead, said method comprising the steps of:

providing at least one ink manifold comprising a plurality of outlets for supplying ink from the manifold to said printhead; and substantially blocking the flow of ink from said outlets to the printhead;

creating a pressure differential between said printhead and said at least one manifold; and selectively unblocking the supply of ink from said outlets to enable ink to be supplied under said pressure differential to the printhead.

The invention is further illustrated, by way of example, with reference to the accompanying drawings, in which:

FIG. 2 represents the relationship between colours displayed on LEDs and the position of a float of a float switch within a header tank of the system shown in FIG. 1;

FIG. 3 represents an example of an ink manifold;

Figure 1:
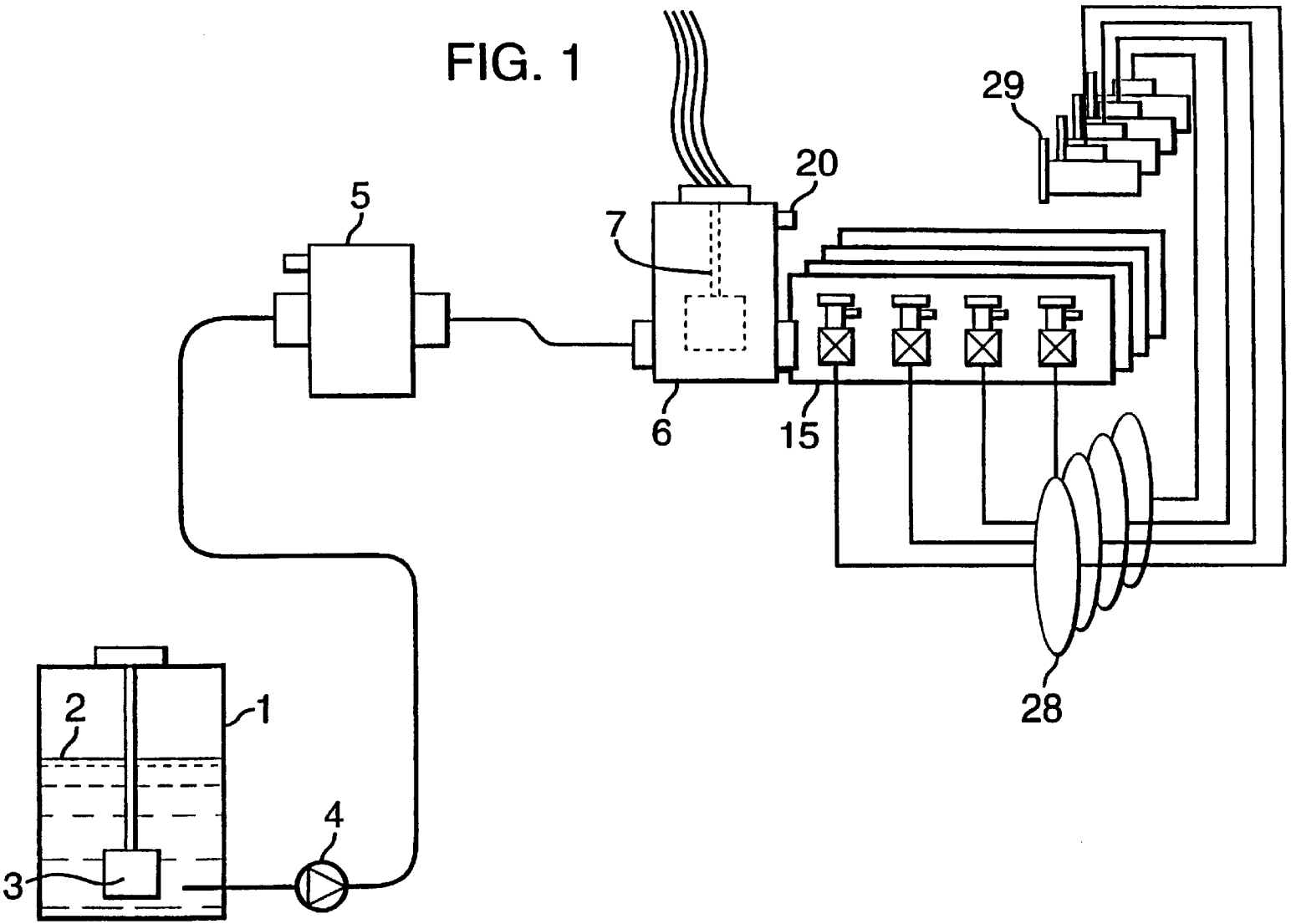
FIG. 1 represents an embodiment of an ink supply system according to the present invention.

FIG. 1 represents a typical ink supply system embodying the present invention. An ink reservoir 1 is provided for storing ink 2. The reservoir 1 is typically a 5 liter tank, but could have a smaller or larger capacity depending on the desired use of the printhead 29. For example, if the printhead has a high ink requirement, for example, for textile or wallpaper printing, a larger tank may be provided. The reservoir 1 is formed from an ink compatible material. This material may be metallic, for example, stainless steel, or plastics, for example, fluorinated HDPE.

A level switch 3 is provided within the reservoir 1 to enable the volume of ink in the reservoir to be monitored. The switch is preferably a float switch, although other electrical or mechanical switches may be used to indicate to the user when the volume of ink within the reservoir is low and thereby enable the ink 2 to be replenished without the need to stop printing.

The ink 2 from the reservoir 1 is pumped by pump 4 through a filter 5 and into a header supply tank 6. Although the use of a pump 4 is optional, as ink may be fed from the reservoir 1 to the header tank 6 under gravity alone, the pump 4 allows for the reservoir tank 1 to be positioned with a higher degree of freedom than if the tank 6 was fed by gravity alone. A diaphragm pump is preferable, as there are no moving parts such as gears to shed contaminants into the ink supply stream. An example of such a pump is manufactured by KNF. However, other suitable forms of pump may be used. The flowrate of the pump is preferably in the region of 100 ml/min. The pump is formed from ink compatible materials, such as polypropylene, PTFE backed peroxide-cured EPDM and Kalrez.

Filter 5 prevents large particles from progressing in the ink supply stream, thereby increasing component life. The filter 5 preferably has a low pressure drop, large capacity and a filtration rating of 5 microns to suit binary or greyscale printheads. The filter is formed from an ink compatible material, for example, the Arbortech Polycap™ HD 36 Product number 2613. Other types of filter formed with, for example, stainless steel mesh are also applicable. The header supply tank 6 contains a three level switch 7 for monitoring the level of the ink within the tank, the switch 7 being linked to the pump 4 by a controller (not shown). The pump 4 is switched on or off by the controller depending on the signal received from the switch 7.

A tri-state LED is provided for indicating the level of the ink within the header tank. With reference to FIG. 2, the float switch 7 comprises a float 8 which floats on the surface of the ink within the header tank 6. As the level of ink within the header tank 6 decreases, the control edge 9 of the float sequentially passes a series of reed switches (not shown) provided at spaced intervals down the tank 6. As a reed switch is passed, it is switched from an open state to a closed state to cause the illumination colour of the LED to change.

With the leading edge 9 within a first, upper region 10 shown in FIG. 2, the LED is a first colour, for example orange, indicating that the level of the ink in the tank is relatively high. As the level of the ink decreases, the leading edge passes first into a second, control region 11, causing the LED to switch to a second colour, for example red, and then, as the leading edge passes a control level 14, into a third, "dead band" region 12, which switches off the LED. When the control level 14 is passed, the pump 4 is activated to replenish the supply of ink in the header tank 6. When the leading edge 9 rises above the control level 14, pumping is stopped. The second region 11 can be considered to be an overshoot region, as the pump 4 is unlikely to stop working precisely when the leading edge 9 rises above the control level. Therefore, the control level 14 should be sufficiently spaced from the top of the header tank 6 so as to avoid over-filling of the tank. If, of any reason, the pump 4 fails or there is a blockage in the system, the leading edge of the float will enter a fourth, lower region 13 causing the LED to switch to a warning colour, for example brown. Of course, any other suitable colour combination may be provided.

Referring back to FIG. 1, ink is supplied from the header tank 6 to at least one manifold 15. An example of such a manifold is shown in FIG. 3. The manifold 15 comprises an inlet 16, a plurality of outlets 17 and at least one valve 18 for selectively closing one or more of the outlets 17. In the example shown in FIG. 3, there is one valve 18 for each of the outlets 17. The valves 18 are preferably on-off valves formed from stainless steel. Each valve is turned on or off by twisting the valve through 90°, and is designed to have a through flow of 3 ml/min during printing.

Figure 4:
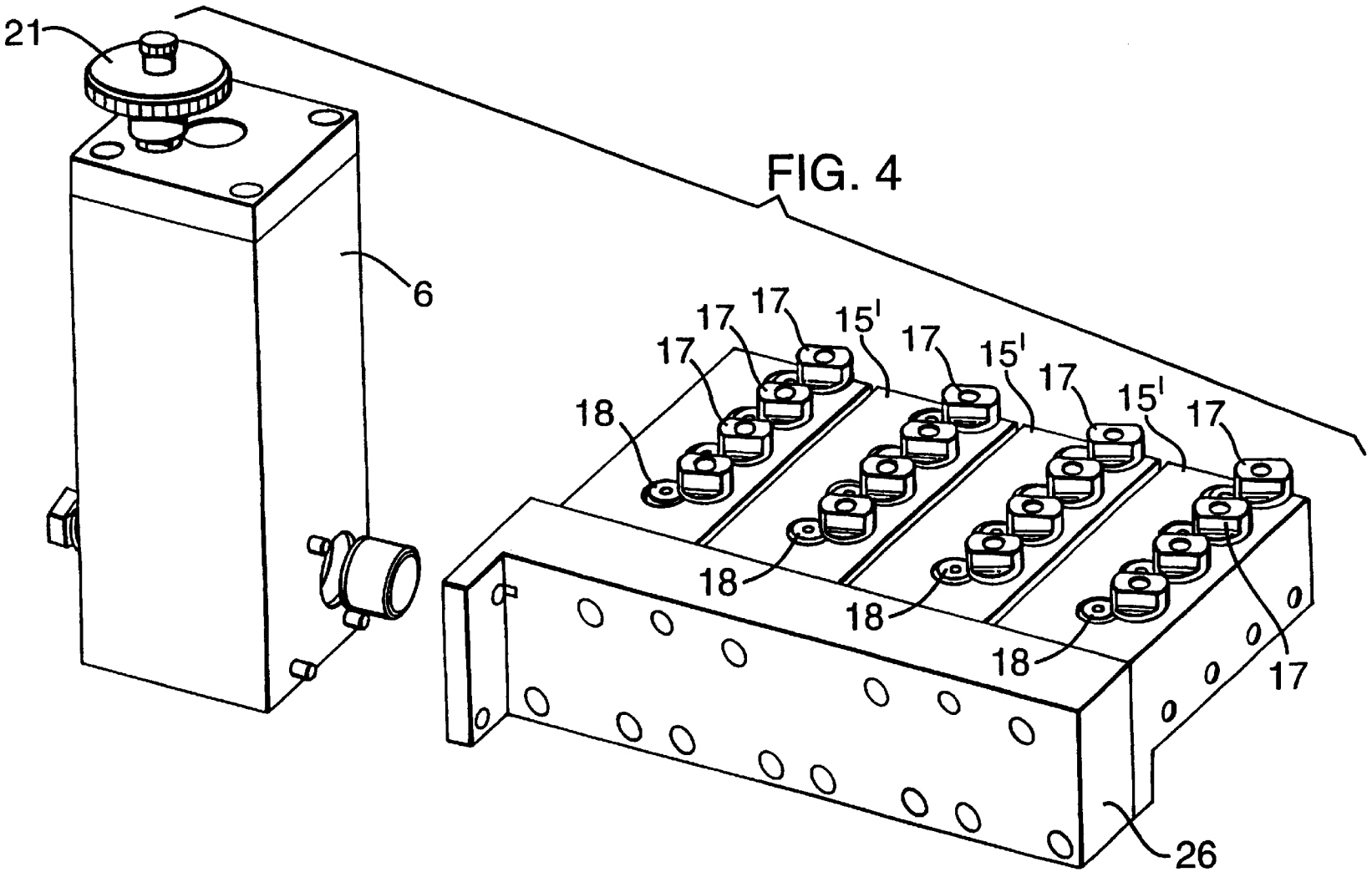
FIG. 4 represents an example of four manifold to be connected to a single header tank.

The number of manifolds and valves is dependent on the type or number of printheads being supplied with ink by the system. For example, with one printhead only there may be one manifold, having one valve for each of the outlets from the manifold. However, two or more manifolds may be provided to supply a single printhead, each having one valve for block all, or alternatively, each of the outlets. If there are a number of printheads to be supplied by the ink supply system, there may be one or more manifolds per printhead. FIG. 4 shows an arrangement of four manifolds 15' for connection to a single header tank 6. Each of these manifolds 15' includes a single valve 18 for closing all of the outlets 17 of the manifold.

Figure 5:
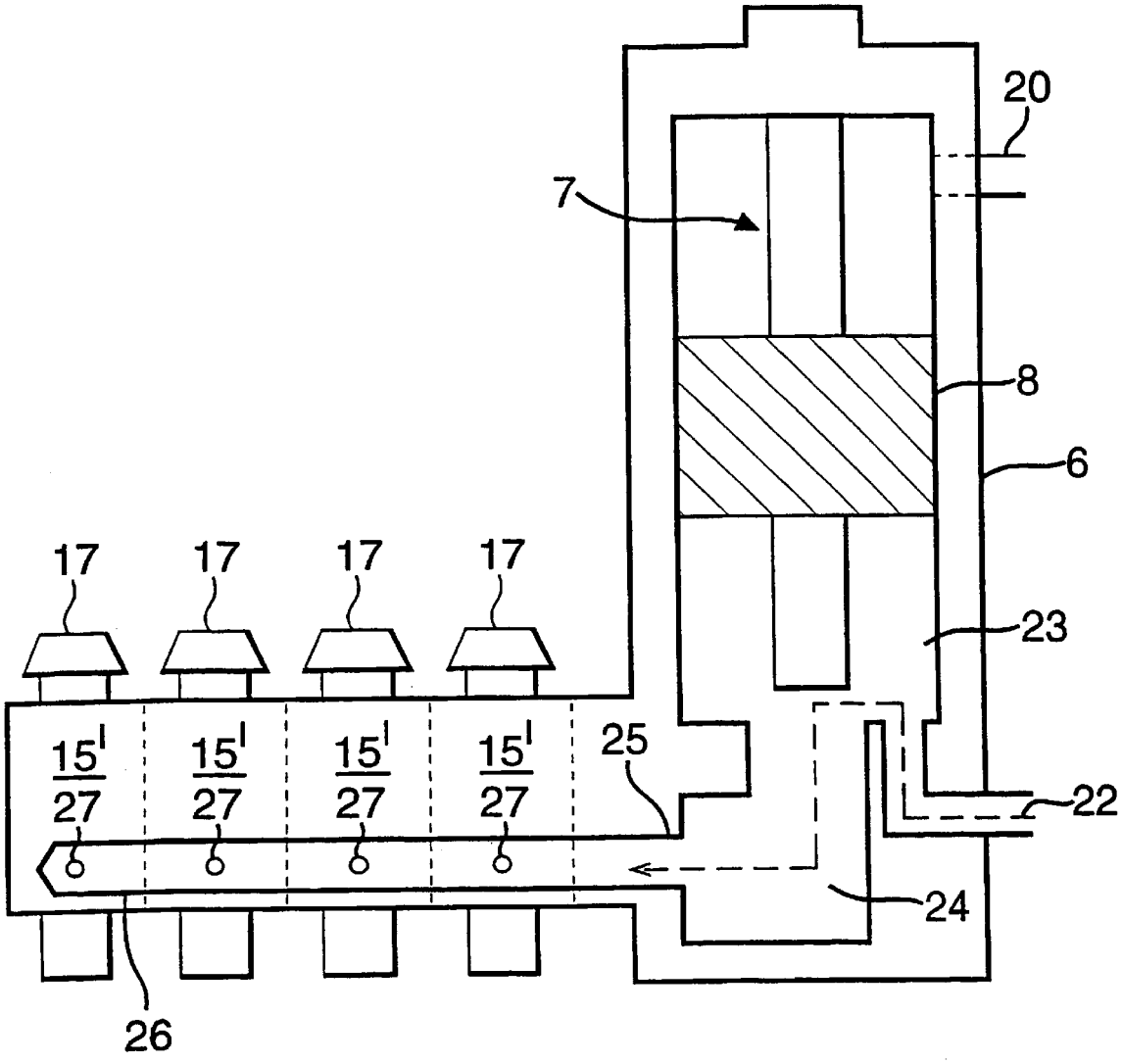
FIG. 5 represents a cross-section of four manifolds connected to a header tank.

FIG. 5 represents a cross-section of four manifolds 15' connected to a header tank 6. The tank 6 has a volume of the order of 50 ml, although this could be larger or smaller depending on the desired use of the printhead 29. The tank 6 is open to the atmosphere through outlet 20 and may have a filter 21 for preventing the ingress of dirt to the tank 6. The outlet may also act as an inlet port during a manual pressure purge by ink injected from a syringe or like device (not shown). The filter 21 may be a Luer lock filter, enabling ink to be injected and filtered simultaneously, and preferably has a nominal retention rating of 5 microns.

Ink is pumped into the header tank 6 via inlet 22. The header tank comprises main chamber 23, level switch 7 within the main chamber 23 as previously discussed and outlet chamber 24. The outlet chamber 24 has a port 25 leading to manifold tube 26 connecting the four manifolds 15' to the header tank 6. Ink flows through orifices 27 in the manifold tube 26 into the manifolds 15'. If the valves 18 are open, ink flows through the valves to the outlets 17. With reference to FIG. 1, the ink then flows through filter block 28 to printhead 29.

The filter block 28 may be integral with, or spaced from, the printhead 29. An example of a printhead capable of supporting a number of different ink inlets is described in WO97/04963, the disclosure of which is incorporated herein by reference. This printhead may operate with a single manifold, or with a plurality of manifolds, for example, four, for supplying ink of a single colour or of a plurality of colours to the nozzles for droplet ejection. These four manifolds may be conveniently filled using the above-described ink supply system. For example, with all of the valves 18 initially closed, a vacuum cap is attached to the nozzles of the printhead to apply a vacuum to the printhead. By opening each of the valves 18 selectively in turn, each of the manifolds of the printhead is supplied with ink in turn. This has been found to increase the efficiency of the vacuum filling as opposed to the simultaneous supply of ink to all of the manifolds of the printhead. Of course, other types of printhead, for example bubblejet or phase change, may be used.

Figure 6:
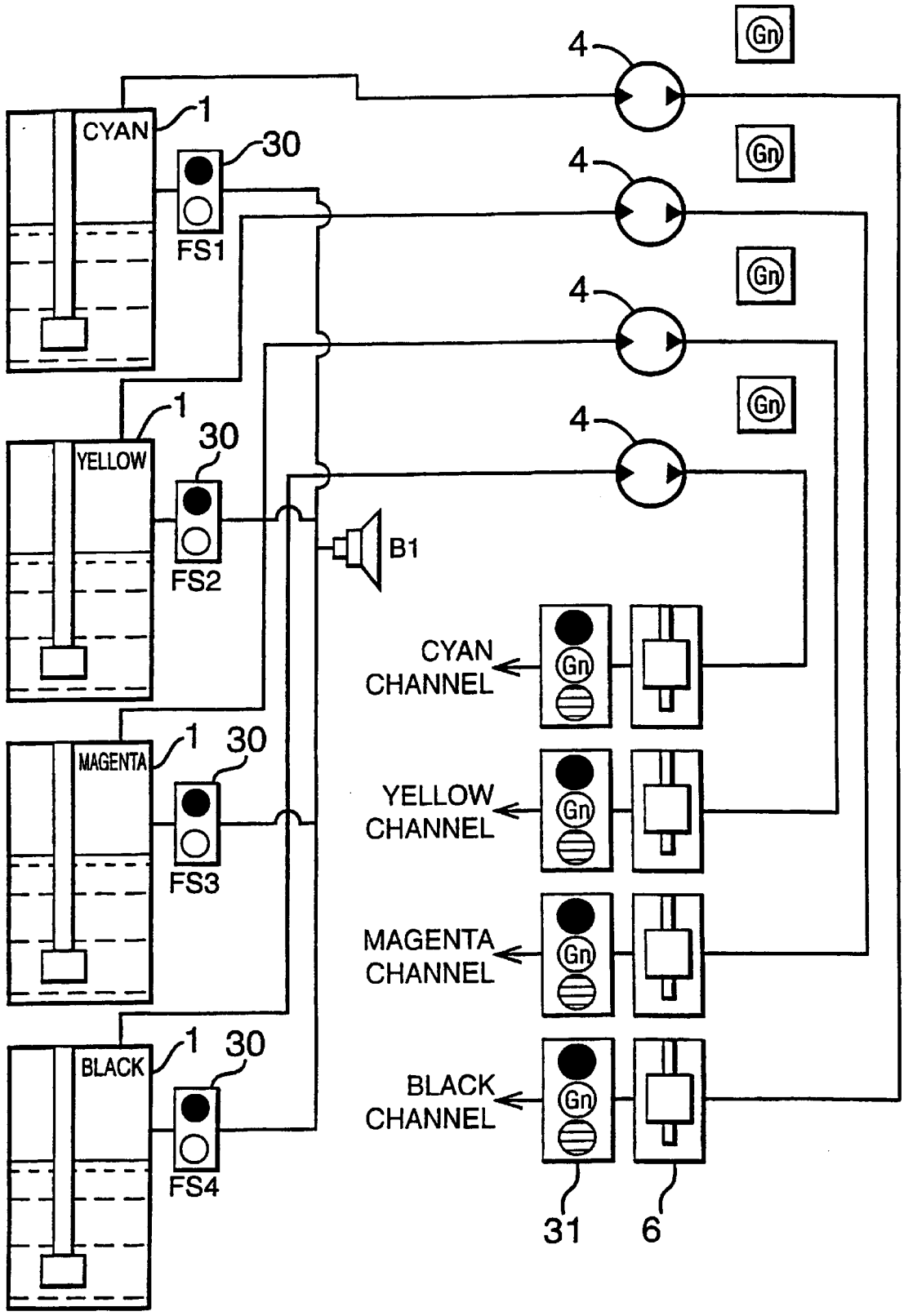
FIG. 6 represents a second embodiment of an ink supply system having four different reservoirs for colour printing.

Whilst the present invention has been described above with reference to the supply of ink from a single reservoir, it is of course possible to supply ink from a number of reservoirs, for example to allow colour printing or when ink requirement of the printhead is particularly high. In this case, as shown in FIG. 6 one header tank will be required for each of the ink colours, with at least one manifold connected to each tank 6. FIG. 6 also shows an arrangement of LEDs 30, 31 for indicating the level of fluid in the reservoirs 1 and tanks 6.

Figure 7:
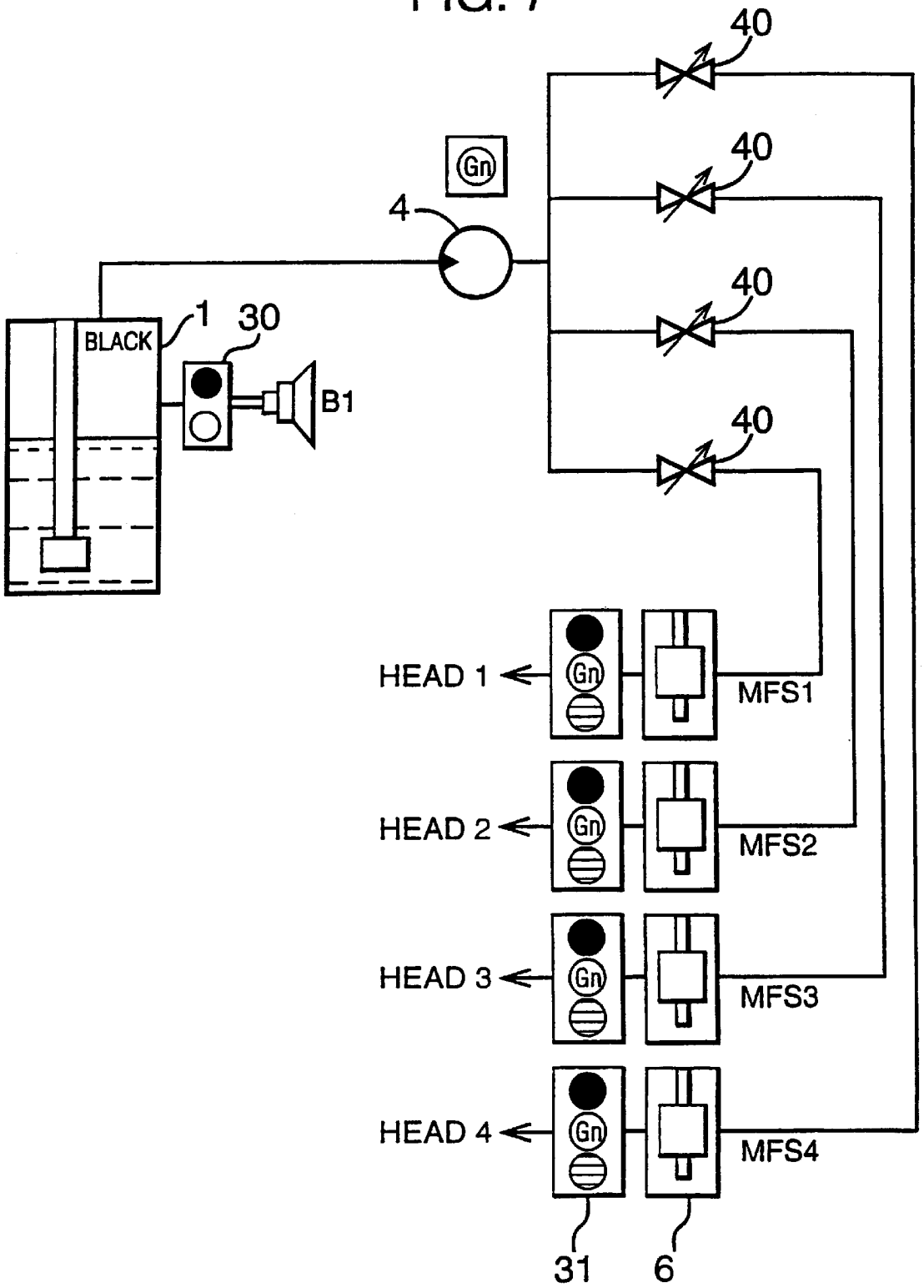
FIG. 7 represents a third embodiment of an ink supply system having four header tanks connected to a single reservoir.

Depending on the ink requirement of the printhead, it is of course possible to use, with the or each reservoir, more than one tank 6 for supplying ink to at least one respective manifold in order to provide the necessary quantity of ink to the printhead. Such an arrangement is shown in FIG. 7. With such an arrangement, is possible that the rate of decrease of the level of ink within the tanks may not be the same. Therefore, if a plurality of header tanks are employed with a single reservoir and pump, it is not preferable to switch off the pump when a float 8 in one of the tanks 6 rises above the control level 14. Instead, as shown in FIG. 7, each tank 6 will require a respective valve 40 for closing the supply of ink from the pump to that chamber when the float 8 within that tank 6 rises above the control level 14.

Each feature disclosed in this specification (which term includes the claims) and/or shown in the drawings may be incorporated in the invention independently of other disclosed and/or illustrated features.

What is claimed is:

1. An ink supply system for supplying ink to a printhead, said system comprising:

at least one ink manifold comprising a plurality of outlets for supplying ink from the manifold of said ink supply system to at least one manifold of said printhead; and means for selectively applying or increasing pressure difference to said ink flow from at least one of the outlets to the printhead.

2. An ink supply system according to claim 1, wherein said means comprises means for selectively substantially blocking the flow of ink from at least one of the outlets to the printhead to increase the pressure of the ink flow from an unblocked outlet to the printhead.

3. An ink supply system according to claim 1, comprising means for filtering ink output from the or each manifold to the printhead.

4. An ink supply system according to claim 1, for supplying ink flow to a plurality of printheads.

5. An ink supply system according to claim 1, comprising a plurality of outlets for supplying ink from the manifold of said ink supply system to at least one manifold of said printhead.

6. An ink supply system for supplying ink to a printhead, said system comprising:

at least one ink manifold comprising a plurality of outlets for supplying ink from the manifold of said ink supply system to at least one manifold of said printhead; and means for selectively substantially blocking said flow of ink from at least one of the outlets to the printhead in order to supply ink from an unblocked outlet to the printhead.

7. An ink supply system according to claim 6, wherein said blocking means comprises at least one valve for selectively closing at least one of said outlets in order to supply ink from an open outlet to the printhead.

8. An ink supply system according to claim 7, wherein said at least one valve is housed within the or each ink manifold.

9. An ink supply system according to claim 7, comprising a plurality of valves, each outlet being selectively closable by a respective valve.

10. An ink supply system according to claim 6, comprising means for supplying ink to the or each ink manifold.

11. An ink supply system according to claim 10, wherein said ink supply means comprises an ink reservoir for storing ink.

12. An ink supply system according to claim 11, wherein said ink supply means comprises a pump for pumping ink from said reservoir to the or each ink manifold.

13. An ink supply system according to claim 11, wherein said ink supply means comprises a tank for receiving ink supplied from said ink reservoir and supplying the received ink to the or each ink manifold.

14. An ink supply system according to claim 13, wherein said ink supply means comprises a valve for selectively connecting said tank to said reservoir to regulate the volume of ink in said tank.

15. An ink supply system according to claim 13, wherein the or each tank comprises means for indicating the volume of ink in that tank.

16. An ink supply system according to claim 15, wherein said indicator means comprises means for indicating the level of ink in the tank.

17. An ink supply system according to claim 10, wherein said ink supply means comprises a plurality of ink reservoirs for storing ink, said ink supply means being arranged to supply ink from each reservoir to at least one ink manifold.

18. An ink supply system according to claim 17, wherein each reservoir stores ink of a respective colour.

19. An ink supply system according to claim 17, wherein said ink supply means comprises a plurality of pumps, each pump being arranged to pump ink from a respective reservoir to said at least one ink manifold.

20. An ink supply system according to claim 19, wherein said ink supply means comprises a plurality of valves, each valve being arranged to selectively connect a respective tank to a respective reservoir to regulate the volume of ink in that tank.

21. An ink supply system according to claim 20, wherein the or each tank comprises means for indicating the volume of ink in that tank.

22. An ink supply system according to claim 21, wherein said indicator means comprises means for indicating the level of ink in the tank.

23. An ink supply system according to claim 17, wherein said ink supply means comprises a plurality of tanks, each tank being arranged to receive ink supplied from a respective ink reservoir and supply the received ink to said at least one ink manifold.

24. An ink supply system according to claim 23, wherein the or each tank comprises means for indicating the volume of ink in that tank.

25. An ink supply system according to claim 24, wherein said indicator means comprises means for indicating the level of ink in the tank.

26. An ink supply system according to claim 6, comprising a plurality of outlets for supplying ink from the manifold of said ink supply system to at least one manifold of said printhead.

27. A method of supplying ink to a printhead, said method comprising the steps of:

providing at least one ink manifold comprising a plurality of outlets for supplying ink from the ink manifold to at least one manifold of said printhead; and selectively applying or increasing a pressure difference of an ink flow from at least one of the outlets to the printhead.

28. A method according to claim 27, wherein the pressure of the ink flow from at least one of the outlets to the printhead is increased by selectively substantially blocking the flow of ink from at least one of the outlets to the printhead, thereby increasing the pressure of the ink flow from an unblocked outlet to the printhead.

29. A method according to claim 27, wherein said ink manifold comprises a plurality of outlets for supplying ink from the manifold of said ink supply system to at least one manifold of said printhead.

30. A method of supplying ink to a printhead, said method comprising the steps of:

providing at least one ink manifold comprising a plurality of outlets for supplying ink from the manifold to at least one manifold of said printhead; and selectively substantially blocking the flow of ink from at least one of the outlets to the printhead in order to supply ink from an unblocked outlet to the printhead.

31. A method according to claim 30, wherein a plurality of outlets for supplying ink from the manifold of said ink supply system to at least one manifold of said printhead.

32. A method of supplying ink to a printhead, said method comprising the steps of:

providing at least one ink manifold comprising a plurality of outlets for supplying ink from the ink manifold to at least one manifold of said printhead; and substantially blocking the flow of ink from at least one of the outlets to the at least one manifold of said printhead;

creating a pressure differential between the at least one manifold of said printhead and said at least one ink manifold; and selectively unblocking the supply of ink from said outlets to enable ink to be supplied under said pressure differential to the at least one manifold of said printhead.

33. A method according to claim 30, wherein a plurality of outlets for supplying ink from the manifold of said ink supply system to at least one manifold of said printhead.

* * * * *

UNITED STATES PATENT AND TRADEMARK OFFICE

CERTIFICATE OF CORRECTION

PATENT NO. : 6,540,340 B2
DATED : April 1, 2003
INVENTOR(S) : Thorpe et al.

It is certified that error appears in the above-identified patent and that said Letters Patent is hereby corrected as shown below:

Column 8,
Line 44, delete “claim 30, wherein” and insert -- claim 32, wherein --.

Signed and Sealed this

Eighth Day of March, 2005

JON W. DUDAS
*Director of the United States Patent and Trademark Office*